US008113514B2

(12) United States Patent
Sekino et al.

(10) Patent No.: US 8,113,514 B2
(45) Date of Patent: Feb. 14, 2012

(54) SHEET DECURLING DEVICE AND IMAGE FORMING APPARATUS

(75) Inventors: Yasuyuki Sekino, Ibaraki (JP); Junji Shirakawa, Ibaraki (JP); Yutaka Shoji, Ibaraki (JP); Takayuki Muneyasu, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 650 days.

(21) Appl. No.: 12/155,793

(22) Filed: Jun. 10, 2008

(65) Prior Publication Data

US 2008/0315496 A1 Dec. 25, 2008

(30) Foreign Application Priority Data

Jun. 22, 2007 (JP) ..... 2007-164602

(51) Int. Cl.
*B65H 5/04* (2006.01)

(52) U.S. Cl. ..... 271/273; 271/302

(58) Field of Classification Search ..... 271/272–274, 271/314, 302

See application file for complete search history.

(56) References Cited

U.S. PATENT DOCUMENTS

| | | | |
|---|---|---|---|
| 4,926,358 A | 5/1990 | Tani et al. | |
| 5,144,385 A | 9/1992 | Tani | |
| 6,343,787 B1 | 2/2002 | Kato et al. | |
| 6,687,570 B1 * | 2/2004 | Sussmeier et al. | 700/220 |

FOREIGN PATENT DOCUMENTS

| | | | |
|---|---|---|---|
| JP | 64-28160 | * | 1/1989 |
| JP | 1-156272 | * | 6/1989 |
| JP | 03-44985 | | 7/1991 |
| JP | 4-173638 | * | 6/1992 |
| JP | 08-175732 | | 7/1996 |
| JP | 10-077152 | | 3/1998 |
| JP | 3050633 | | 3/2000 |
| JP | 2005-053607 | | 3/2005 |
| JP | 2005-53607 | * | 3/2005 |
| JP | 2006-273470 | | 10/2006 |

OTHER PUBLICATIONS

English translation of JP 2005-53607.*
English translation of Detailed Description section of Japanese Publication No. 10-77152.*
English Language Abstract of JP 59-108642 dated Jun. 23, 1984.
English Language Abstract of JP 04-344663 dated Dec. 1, 1992.
Extended European Search Report dated Aug. 4, 2010 for corresponding Application No. 08252098.2.

* cited by examiner

*Primary Examiner* — Stefanos Karmis
*Assistant Examiner* — Thomas Morrison
(74) *Attorney, Agent, or Firm* — Harness, Dickey & Pierce, PLC

(57) ABSTRACT

A moving unit includes first and second transportation paths that can selectively link to main transportation path of a recording sheet, a first roller arranged between the first and the second transportation paths, second and third rollers capable of making contact with the first roller across the first and the second transportation paths, respectively. When the moving unit moves to a position at which the first transportation path or the second transportation path is linked to the main transportation path, a mechanism varies a pressing force of the second roller or the third roller with respect to the first roller.

10 Claims, 9 Drawing Sheets

SHEET DECURLING DEVICE AND IMAGE FORMING APPARATUS

CROSS-REFERENCE TO RELATED APPLICATIONS

The present application claims priority to and incorporates by reference the entire contents of Japanese priority document 2007-164602 filed in Japan on Jun. 22, 2007.

BACKGROUND OF THE INVENTION

1. Field of the Invention

The present invention relates to a sheet decurling device and an image forming apparatus, and more particularly, to a structure that removes a curl of a sheet that occurs during a transporting process.

2. Description of the Related Art

In an image forming apparatus such as a multi function peripheral (MFP), a printer, a facsimile etc., visual images such as toner images, which are carried on a surface of photosensitive drums that are latent image carrying members, are transferred onto a sheet such as a recording sheet. The sheet is fixed by a fixing device using addition of heat and is ejected.

In the fixing device, a toner image carrying surface of the sheet touches a heating source member such as a heating roller and heat and pressure are used to cause the toner to melt and penetrate the sheet, thus fixing the toner on the sheet.

Upon receiving the heat from the heat source member, moisture of the sheet that is subjected to fixing evaporates, thus causing a change in a moisture content percentage of a sheet surface that is touching the heating source member and a back surface. Change in the moisture content percentage causes occurrence of warping in a thickness direction, in other words, a rolling tendency called a curl.

When the curled sheet is ejected and stacked, end edge positions of the stacked sheets do not align, thus necessitating an operation to align side end edges of the sheets when stacking is completed.

In one of the existing structures that is disclosed in Japanese Patent No. 3050633 and that is used to curb a curl, the sheet that has passed the fixing device is caused to touch a cooling member such as a heat pipe, thus curbing evaporation of the moisture content. Alternatively, in a structure that decurls the sheet and that is disclosed in Japanese Patent Application Laid-open No. H3-44985, among a pair of rollers that sandwich-transport the sheet, a speed of the roller opposite to a curled surface side of the sheet is enhanced at the time of sandwich-transportation of the sheet and the sheet is forcibly beaten to cause occurrence of curl such that the surface of the sheet opposite the roller with the enhanced speed is rolled around the side of the roller.

SUMMARY OF THE INVENTION

It is an object of the present invention to at least partially solve the problems in the conventional technology.

According to an aspect of the present invention, there is provided a sheet decurling device that decurls a recording sheet, including a first transportation path and a second transportation path that can selectively link to a main transportation path of the recording sheet; a first roller arranged between the first transportation path and the second transportation path; a second roller capable of making contact with the first roller across the first transportation path; a third roller capable of making contact with the first roller across the second transportation path; a moving unit that includes the first transportation path, the second transportation path, the first roller, the second roller, the third roller, and a driving source that drives the first roller, and that moves its position such that the first transportation path and the second transportation path are selectively linked to the main transportation path; a moving position detecting unit that detects a position of the moving unit; and a mechanism that varies, upon the moving unit moving to a position at which either one of the first transportation path and the second transportation path is linked to the main transportation path, a pressing force of the second roller or the third roller with respect to the first roller.

Furthermore, according to another aspect of the present invention, there is provided an image forming apparatus including a sheet decurling device that decurls a recording sheet. The sheet decurling device includes a first transportation path and a second transportation path that can selectively link to a main transportation path of the recording sheet; a first roller arranged between the first transportation path and the second transportation path; a second roller capable of making contact with the first roller across the first transportation path; a third roller capable of making contact with the first roller across the second transportation path; a moving unit that includes the first transportation path, the second transportation path, the first roller, the second roller, the third roller, and a driving source that drives the first roller, and that moves its position such that the first transportation path and the second transportation path are selectively linked to the main transportation path; a moving position detecting unit that detects a position of the moving unit; and a mechanism that varies, upon the moving unit moving to a position at which either one of the first transportation path and the second transportation path is linked to the main transportation path, a pressing force of the second roller or the third roller with respect to the first roller.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 11:
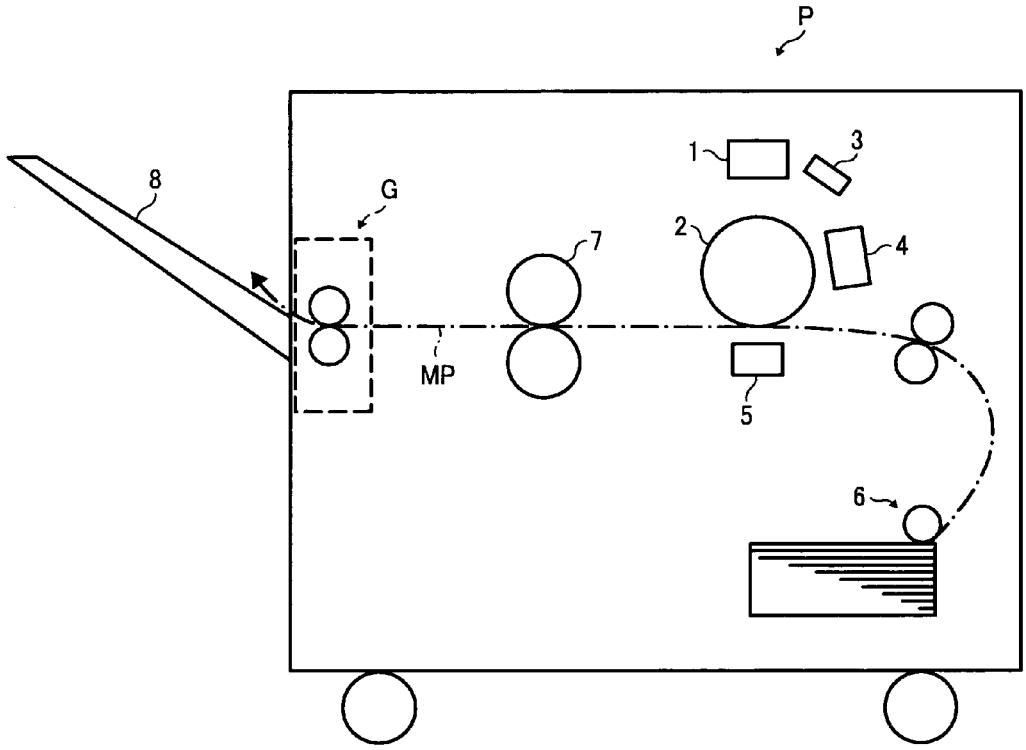
FIG. 11 is a schematic for explaining an example of an existing image forming apparatus that uses a sheet decurling device.

An installation site of a sheet decurling device is explained first. FIG. 11 is a schematic of an overview of an image forming apparatus P that uses a common electronographic method and the sheet decurling device.

Based on a principle of a common electronographic printer, after a charger 1 has uniformly charged a photosensitive drum 2, an optical unit 3 emits light on a surface of the photosensitive drum 2.

Due to emission of light, an electric charge on the surface of the photosensitive drum 2 partially escapes, and an electrostatic latent image is formed on the surface of the photosensitive drum 2. Next, a developer 4 adheres a toner, which is reversely charged with respect to the photosensitive drum 2, on the electrostatic latent image to form a visual image. Next, a toner image, which is formed on the surface of the photosensitive drum 2, is transferred by a transfer unit 5 onto a sheet that is a recording member and that is transported via a string of transportation paths from a sheet feeder 6. A fixing unit 7, which includes a heating and pressurizing roller, melts the toner that is transferred onto the recording member to form an image on the sheet. Next, the sheet is transported to a discharging unit 8.

During a flow of the string mentioned earlier, when using the fixing unit 7 to carry out fusion of the toner on the sheet that includes the transferred toner image, addition of heat by the fixing unit 7 results in evaporation of water vapor included in the sheet. Due to this, a curl occurs in a transfer surface side or an opposite side of the sheet.

To overcome the drawback of occurrence of the curl, the sheet decurling device is necessitated in the vicinity of a G portion on a transportation path from the fixing unit 7 of the printer towards the discharging unit 8. Due to this, when the sheet, which is curled at the time of passing the fixing unit 7 and moving towards the discharging unit 8, passes the sheet decurling device, the curl is corrected by the sheet decurling device.

The sheet decurling device according to the present invention is explained next.

Figure 10:
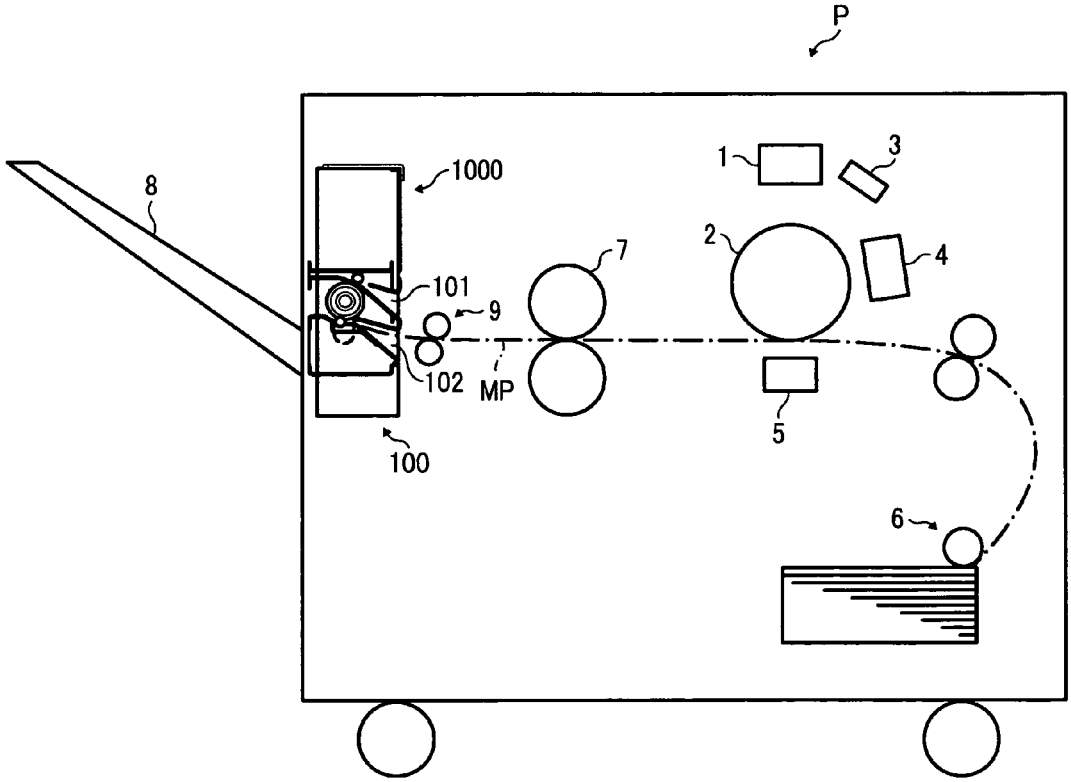
FIG. 10 is a schematic of an image forming apparatus that incorporates the sheet decurling device according to the present invention.

As shown in FIG. 10, a sheet decurling device 1000 according to the present invention includes a moving unit 100 such that a first transportation path 101 and a second transportation path 102, which are internally included, can be selectively linked to a main path MP. The sheet decurling device 1000 shown in FIG. 10 is internally embedded into the image forming apparatus. However, the sheet decurling device according to the present invention can also be arranged separately from the image forming apparatus. For example, the sheet decurling device can be arranged at an entrance of a sorter, a collator, or a stacking device that are used in a post process of a recording sheet.

Figure 1:
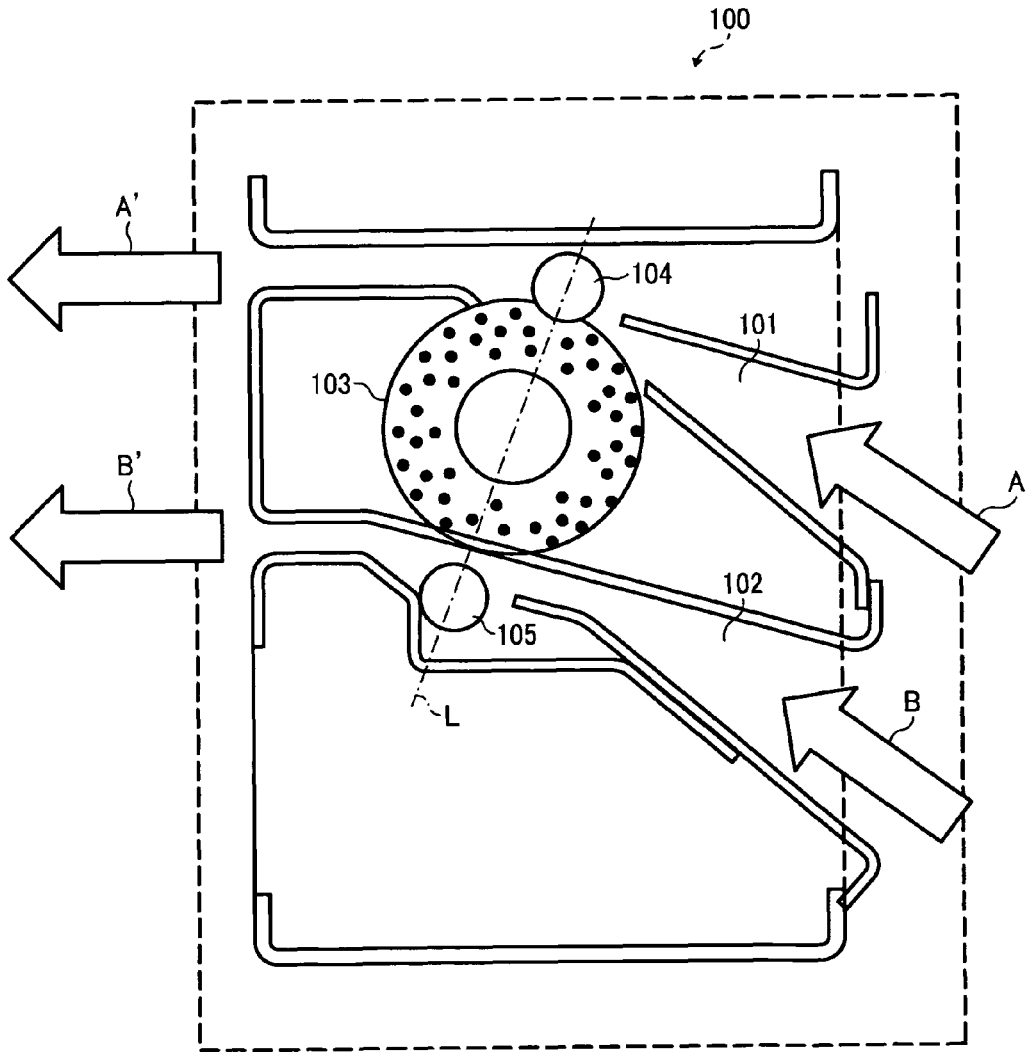
FIG. 1 is a schematic for explaining a structure of a sheet decurling device according to an embodiment of the present invention.

FIG. 1 is a schematic for explaining an internal structure of the moving unit 100. As shown in FIG. 1, the moving unit 100 includes a first roller 103, a second roller 104, and a third roller 105. The first roller 103 is arranged between the first transportation path 101 and the second transportation path 102 such that a portion of a peripheral surface of the first roller 103 is exposed to the first transportation path 101 and the second transportation path 102. The second roller 104 can touch the first roller 103 across the first transportation path 101. The third roller 105 can touch the first roller 103 across the second transportation path 102.

As shown in FIG. 10, the first transportation path 101 and the second transportation path 102 include an angle, indicated by arrows A and B respectively, that can link with an entering direction of the recording sheet that is set by transportation rollers 9 shown in FIG. 10, and an angle, indicated by arrows A' and B' respectively, that can set an ejection direction that can link to the discharging unit 8 shown in FIG. 10.

The first roller 103 is formed of an elastic body such as sponge rubber. The second roller 104 and the third roller 105 are metal rollers formed of stainless steel. The second roller 104 is used as an upper pressure roller that is positioned on the upper side of the first roller 103 and the third roller 105 is used as a lower pressure roller that is positioned on the lower side of the first roller 103. The second roller 104 and the third roller 105 are pressed against the first roller 103, thus enabling the second roller 104 and the third roller 105 to function as decurling rollers that correct the curl by causing the recording sheet to roll in a reverse direction of a curl direction.

The second roller 104 and the third roller 105 are opposite to each other across the first roller 103 and are positioned such that a line L, which joins touching positions of the second roller 104 and the third roller 105 with respect to the first roller 103, is perpendicular to progressing directions of the sheet that enters from the first transportation path 101 and the second transportation path 102 (directions indicated by the arrows A and B respectively). Due to this, the recording sheet, which enters inside the sheet decurling device 1000, can enter in a tangential direction with respect to the first roller 103, the second roller 104, and the third roller 105, and can receive pressure from the first roller 103, the second roller 104, and the third roller 105 most efficiently.

As shown in FIG. 1, for selectively linking the first transportation path 101 and the second transportation path 102 to the main transportation path MP, the moving unit 100 can move in a perpendicular direction.

Figure 2:
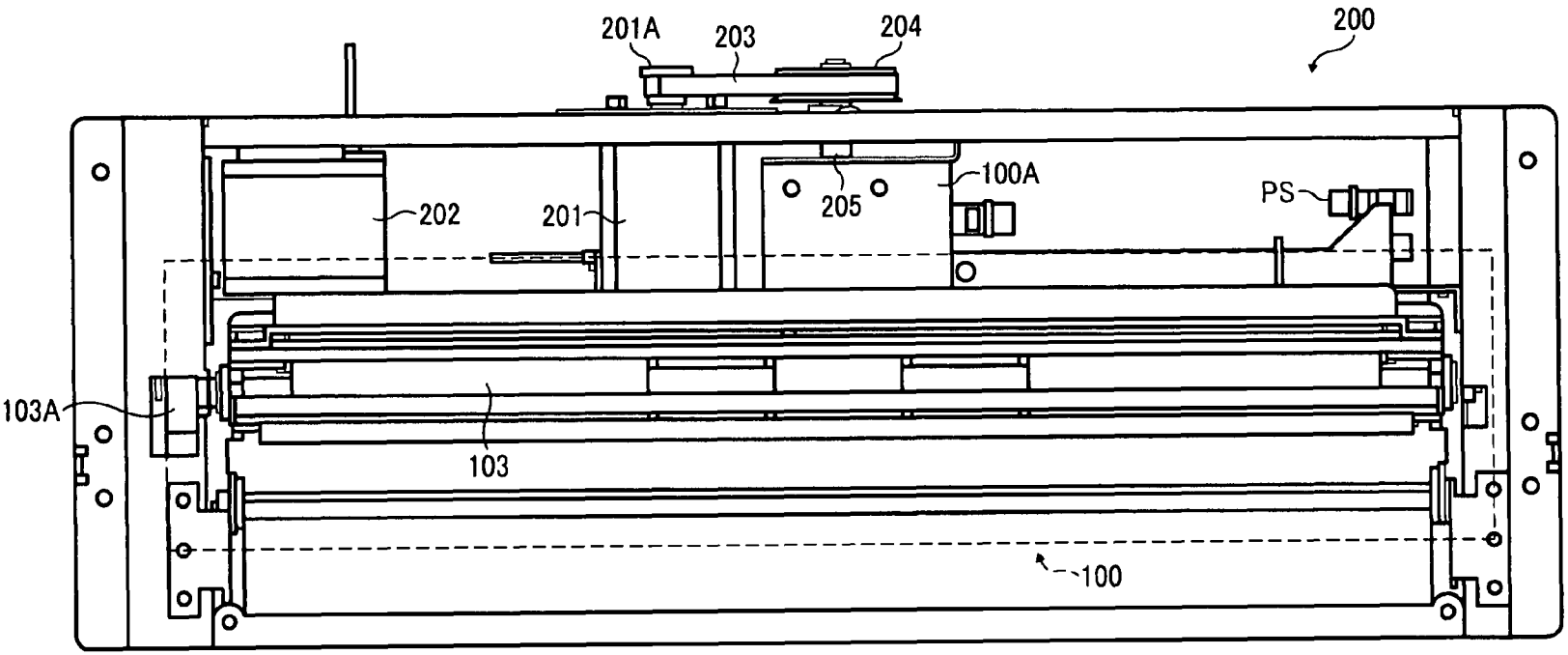
FIG. 2 is a schematic of a concrete example of the sheet decurling device shown in FIG. 1 viewed from an ejection direction of a recording material.
Figure 3:
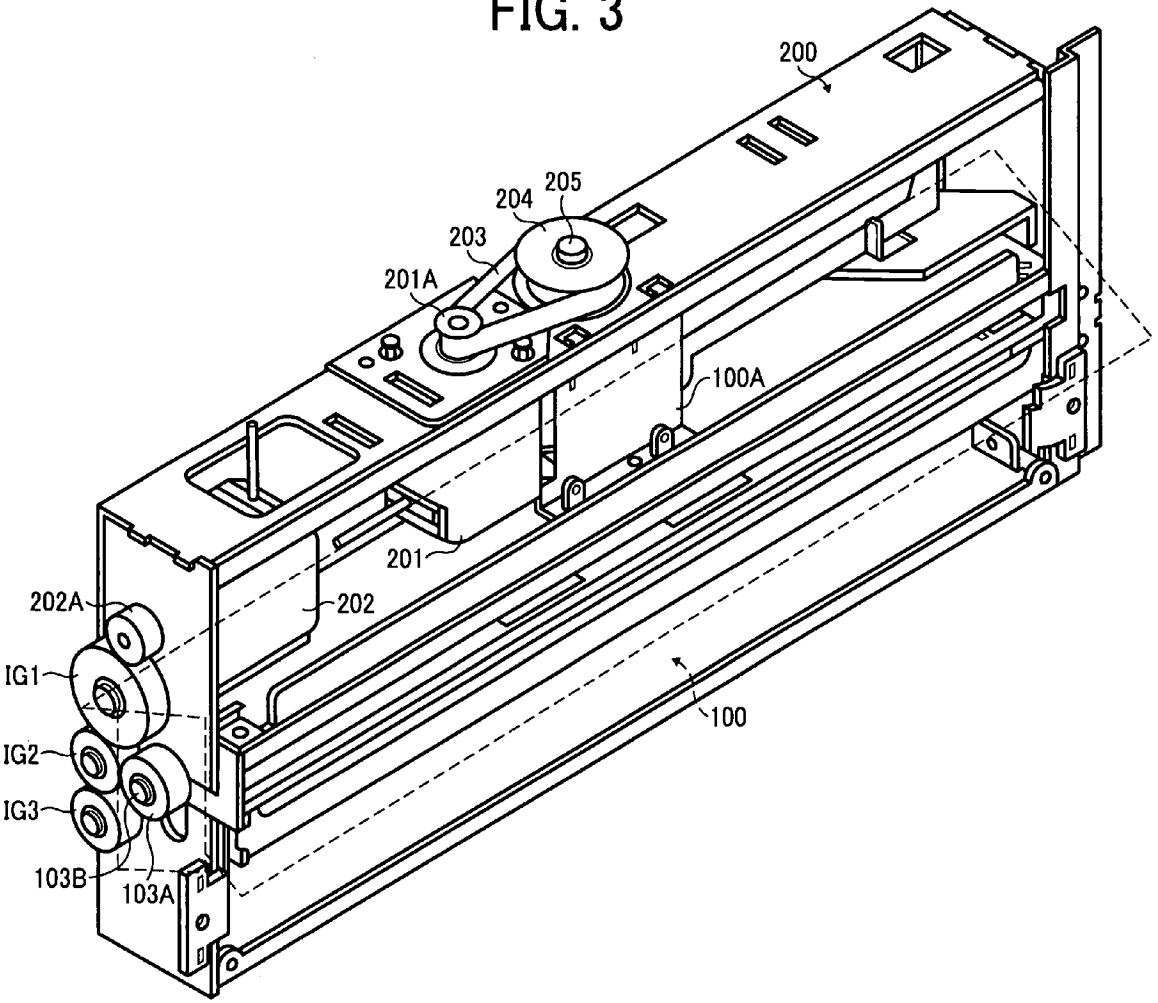
FIG. 3 is a schematic of the sheet decurling device shown in FIG. 2.

FIGS. 2 and 3 are schematics of the moving unit 100 and a moving mechanism of the moving unit 100. As shown in FIG. 2, an elevating unit 200, which includes a motor 201 and a motor 202, is arranged in an upper portion of the moving unit 100 that is indicated by a dotted line. The motor 201 is an elevatably driving source of the moving unit 100 and the motor 202 is a rotatably driving source of the first roller 103.

As shown in FIG. 3, a chassis portion of the elevating unit 200 surrounds a periphery of the moving unit 100. Due to this, the moving unit 100 can elevate inside the elevating unit 200 that is arranged separately from the moving unit 100.

A driving pulley 201A is arranged on the motor 201 that is arranged as the elevatably driving source on the elevating unit 200. An elevating screw 205, which is integrated with a driven pulley 204, can link with the driving pulley 201A via a belt 203.

The elevating screw 205 is fitted to a not shown nut inside a side wall 100A that is integrated with the upper portion of the moving unit 100. The moving unit 100 is elevated according to a rotation direction of the elevating screw 205.

An elevation position of the moving unit 100 is detected by a position detecting sensor PS (see FIG. 2) that uses an optical sensor that can detect light interception upon entry of a sector member that is arranged on a side of the moving unit 100. The moving unit 100 stops at a predetermined position.

An elevation amount of the moving unit 100 is equivalent to a distance till a position that enables any one of the first transportation path 101 and the second transportation path 102 to link to the main transportation path MP.

A plurality of idle gears IG1 to IG3, which can link with the motor 202, are arranged on the motor 202 that is arranged on the elevating unit 200 as the rotatably driving source. The idle gears IG1 to IG3 treat as a first level, a driving gear 202A that is fixed to an output shaft of the motor 202. A decurler roller gear 103A, which is fixed to a rotating shaft 103B of the first roller 103, meshes with the idle gear IG3 of the last level.

The sheet decurling device includes a structure that changes a touching force of any one of the second roller 104 and the third roller 105 with respect to the first roller 103 when any one of the first transportation path 101 and the second transportation path 102 moves to a position that links to the main transportation path MP. The structure and working of the structure are explained next with reference to FIG. 4 onwards.

Figure 4:
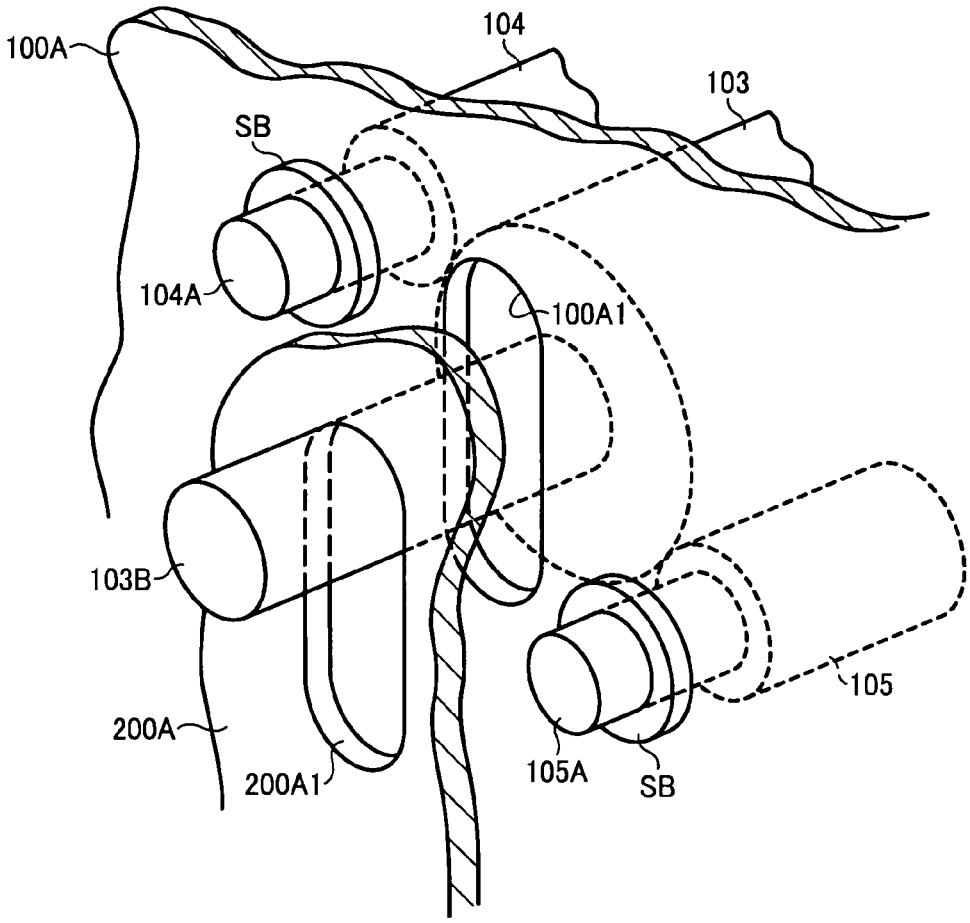
FIG. 4 is a schematic for explaining a principle that is related to a movement of a moving unit shown in FIG. 2.

FIG. 4 is a schematic for explaining a principle that is used for causing the moving unit 100 at the elevation position to change a pressurizing force of the second roller 104 and the third roller 105 with respect to the first roller 103.

As shown in FIG. 4, rotating shafts 103B, 104A, and 105A, of the first roller 103, the second roller 104, and the third roller 105 respectively, are inserted into the side wall 100A of the moving unit 100.

Among the rotating shafts 103B, 104A, and 105A, an axial end of the rotating shaft 103B of the first roller 103 is inserted into a long hole 200A1 that is formed in a side wall 200A of the elevating unit 200 that is arranged separately from the moving unit 100. The long hole 200A1, which is formed in the side wall 200A, is arranged along a moving direction of the moving unit 100.

In the side wall 101A of the moving unit 100, the rotating shaft 103B of the first roller 103 is inserted into a freely-moving supporting unit 100A1 that is formed as a long hole along the moving direction of the moving unit 100. The rotating shafts 104A and 105A of the second roller 104 and the third roller 105 respectively are rotatably supported via a shaft bearing SB. Unlike the supporting unit 100A1, the shaft bearing SB does not cause the rotating shafts 104A and 105A to move in the moving direction of the moving unit 100.

By adding a longitudinal direction length of the supporting unit 100A1 that is arranged in the side wall 100A of the moving unit 100 to a longitudinal direction length of the long hole 200A1 that is formed in the side wall 200A on the side of the elevating unit 200, a stroke is set that enables the second roller 104 and the third roller 105 to increase the pressurizing force with respect to the first roller 103.

In the structure mentioned earlier, when the first roller 103 is pressed against an end of the long hole 200A1 due to a movement of the moving unit 100 and the moving unit 100 continues to move, the second roller 104 and the third roller 105 move independently with respect to the first roller 103, and depending on the moving direction, the pressurizing force of any one of the second roller 104 and the third roller 105 with respect to the first roller 103 increases.

For example, when the moving unit 100 is elevated, the rotating shaft 103B of the first roller 103 is pressed against an end, in other words, the upper end, of the long hole 200A1, and the moving unit 100 continues to be elevated further, the supporting unit 100A1 can cause the moving unit 100 to move without interfering with the first roller 103. Due to this, the third roller 105, which is positioned in a peripherally downward direction with respect to the first roller 103, is pressed against the first roller 103 and the pressurizing force of the third roller 105 with respect to the first roller 103 increases.

When the moving unit 100 moves downward, the rotating shaft 103B of the first roller 103 is pressed against the lower end of the long hole 200A1, and the moving unit 100 continues to move downward, the supporting unit 100A1 can cause the moving unit 100 to move without interfering with the rotating shaft 103B of the first roller 103. Due to this, the second roller 104, which is positioned in a peripherally upward direction with respect to the first roller 103, is pressed against the first roller 103. Thus, the pressurizing force of the second roller 104 with respect to the first roller 103 increases.

Figure 5:
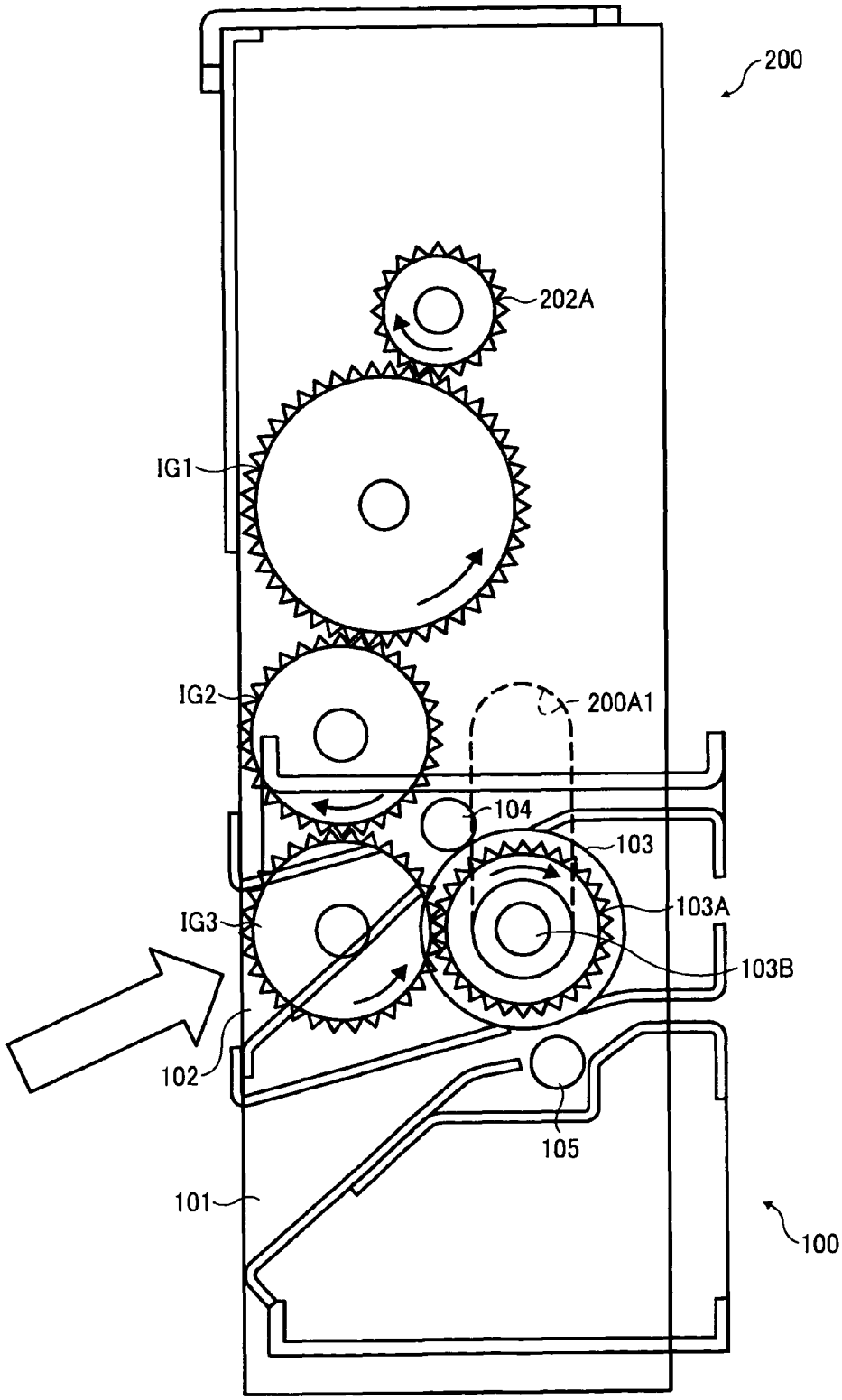
FIG. 5 is a schematic of a structure of a roller driving system that is used in the sheet decurling device that is shown in FIG. 2.
Figure 6:
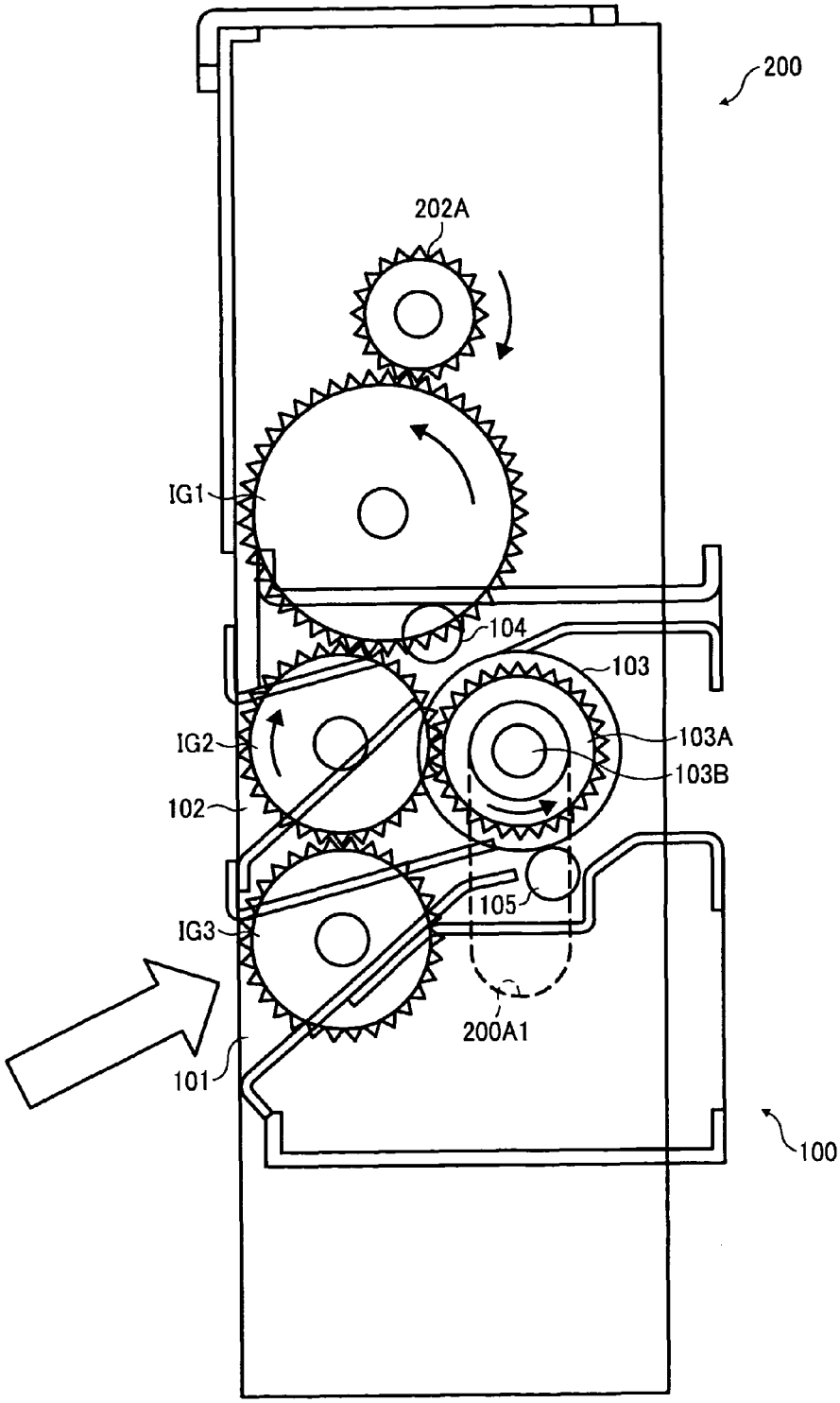
FIG. 6 is a schematic for explaining a condition during a movement of the roller driving system shown in FIG. 5.

FIGS. 5 and 6 are schematics for explaining a driving path towards the first roller 103 according to a movement position of the moving unit 100. A side surface shown in FIGS. 5 and 6 indicates a side surface that is seen from the opposite side of the side surface shown in FIG. 1.

FIG. 5 is a schematic of the driving path when the moving unit 100 is elevated and the second roller 104 is touching the first roller 103. FIG. 6 is a schematic of the driving path when the moving unit 100 has moved downward and the third roller 105 is touching the first roller 103.

As shown in FIG. 5, when the moving unit 100 is being elevated, a torque from the driving gear 202A of the motor 202, which is set to rotate in one direction, is transmitted to the idle gears IG1 to IG3. Further, the torque is also transmitted to the decurler roller gear. 103A that meshes with the idle gear IG3.

As shown in FIG. 6, when the moving unit 100 is moving down, the torque from the driving gear 202A on the side of the motor 202 is transmitted to the idle gears IG1 and IG2. Further, the torque is also transmitted to the decurler roller gear 103A that meshes with the idle gear IG2.

Thus, simply setting a rotation direction of the motor 202 to one direction enables to establish a meshing relation between the idle gears IG1 to IG3 and the decurler roller gear 103A that are opposite to each other when the moving unit 100 is elevated, thus enabling to set the rotation direction of the first roller 103 such that the first roller 103 can eject the sheet using the first transportation path 101 and the second transportation path 102.

Thus, in the present embodiment, using the structure mentioned earlier enables to set a position such that any one of the first transportation path 101 and the second transportation path 102 links to the main transportation path MP according to the moving direction of the moving unit 100.

Figure 7:
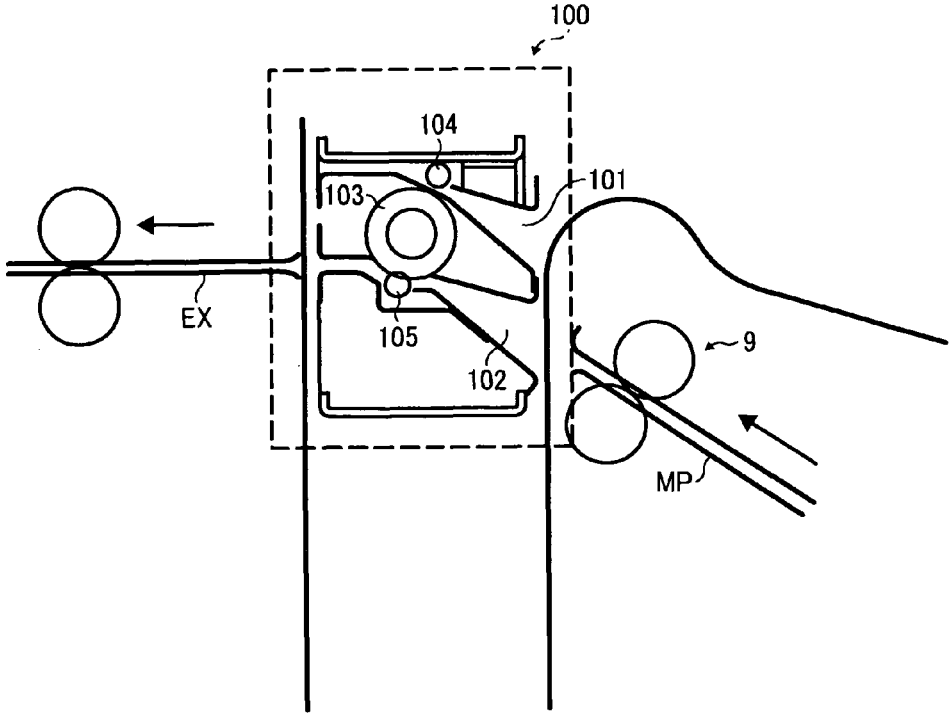
FIG. 7 is a schematic for explaining a mode in the sheet decurling device shown in FIG. 2.
Figure 8:
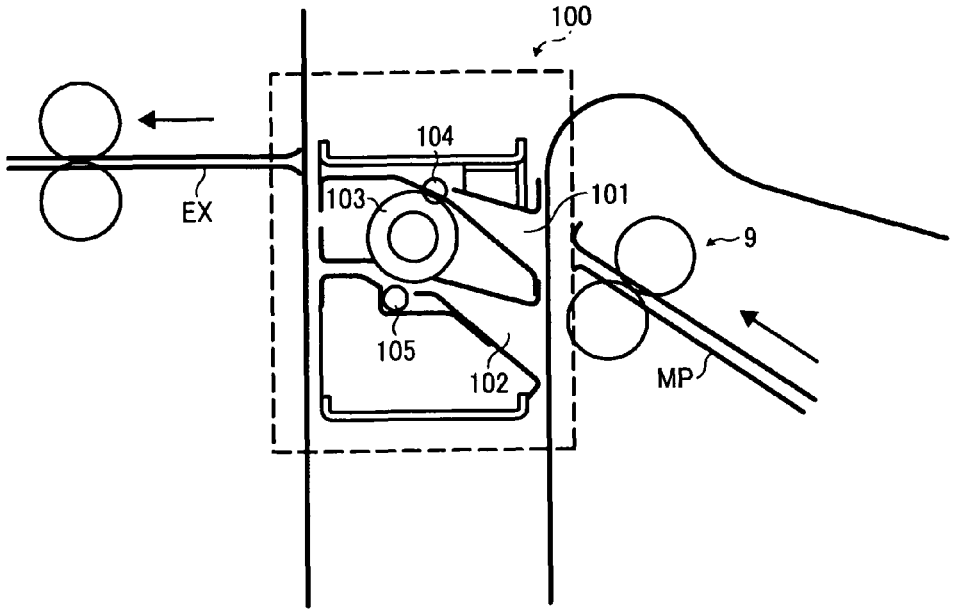
FIG. 8 is a schematic for explaining another mode in the sheet decurling device shown in FIG. 2.

FIGS. 7 and 8 are schematics for explaining a relation among the moving unit 100, the main transportation path MP, and an ejection path (for the sake of convenience, the ejection path is indicated by a symbol EX) that is turned towards the discharging unit 8. The ejection path when the moving unit 100 is elevated is shown in FIG. 7. The ejection path when the moving unit 100 has moved downwards is shown in FIG. 8.

As shown in FIG. 7, if the curl of the recording sheet, which is transported via the main transportation path MP that is arranged on a main body side of the image forming apparatus, is concave shaped, the moving unit 100 is elevated and a condition shown in FIG. 7 is set. Thus, the second transportation path 102 in the moving unit 100 links to the main transportation path MP and based on the operation explained with reference to FIG. 4, the pressurizing force of the third roller 105 with respect to the first roller 103 increases. Due to this, the recording sheet, which is sandwich-transported by the first roller 103 and the third roller 105, is subjected to decurling in an opposite direction of the curl direction of the curl that occurs in the recording sheet itself and the curl is corrected.

If the curl of the recording sheet is convex shaped, the moving unit 100 moves downward and a condition shown in FIG. 8 is set. Thus, the first transportation path 101 in the moving unit 100 continues to the main transportation path MP and the pressurizing force of the second roller 104 with respect to the first roller 103 increases. Due to this, the recording sheet, which is sandwich-transported by the first roller 103 and the second roller 104, is subjected to decurling in the opposite direction of the curl direction of the curl that occurs in the recording sheet itself and the curl is corrected.

Thus, in any one of the operations explained with reference to FIGS. 7 and 8, a configuration of the first transportation path 101 and the second transportation path 102 is linked to the ejection path EX. Due to this, the recording sheet, which is sandwich-transported among the first roller 103, the second roller 104, and the third roller 105, is ejected normally without occurrence of an ejection defect.

If the curl direction is prior recognized, an elevation setting of the moving unit 100 can be carried out to set the condition that can carry out curl correction. However, the elevation setting of the moving unit 100 can also be set by prior estimating the curl direction. A structure which prior estimates the curl direction is explained below.

Because the curl direction and a curl amount change according to a sheet size, environmental temperature and humidity, an area ratio of the toner image etc., in the present embodiment, rotation control of the motor 201, which is a movably driving source of the moving unit 100, can also be carried out.

Figure 9:
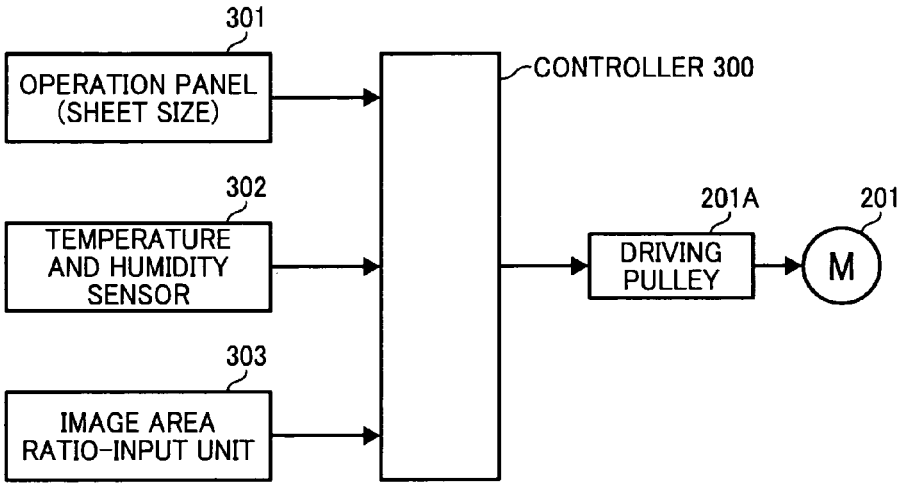
FIG. 9 is a block diagram of a controller that is used for rotation control of the moving unit in the sheet decurling device shown in FIG. 2.

FIG. 9 is a functional block diagram of a controller 300 that is used for rotation control of the motor 201. As shown in FIG. 9, a controller, which executes an image forming sequence, is used as the controller 300. An operation panel 301, which enables specification of the sheet size, a temperature and humidity sensor 302, and an image area ratio-input unit 303 are connected to an input side of the controller 300. The driving pulley 201A of the motor 201 is connected to an output side of the controller 300.

Based on pixel signals from a scanner or received image signals, the image area ratio-input unit 303, which is connected to the controller 300, calculates an image area ratio with respect to the sheet size.

Based on input data such as the sheet size, the temperature and humidity, or the image area ratio, the controller 300 prior estimates the curl direction of the curl that occurs in the recording sheet and sets a selection of the first transportation path 101 and the second transportation path 102 and the rotation direction of the motor 201 such that the recording sheet can be subjected to decurling in the opposite direction of the curl direction.

The curl direction and the curl amount are affected by a moisture content percentage of the recording sheet. Testing an evaporation rate of the moisture content due to heating during fixing enables to prior estimate the curl direction and the curl amount to some extent. Apart from a sheet area, the sheet size can also include a sheet thickness.

A relation between the sheet size and the image area ratio that are affected by the evaporation rate of the moisture is mapped. Further, a relation between the temperature and humidity and the evaporation rate of the moisture content is also mapped. A correspondence is established between each input data and the evaporation rate of the moisture content to prior estimate the curl direction and the curl amount and to set the condition that enables to correct the curl, in other words, to set a movement amount of the moving unit 100 that enables to regulate the selection of a transportation path and a pressurizing force for correction. When prior estimating the curl direction and the curl amount, if occurrence of the curl is negligible, the controller 300 can also decide that movement of the moving unit 100 is not necessary.

In the structure mentioned earlier, based on each data of the sheet size, the temperature and humidity, and the image area ratio, the evaporation rate of the moisture content is determined. Further, based on a map of a relation between the evaporation amount and the curl amount, a curl correction amount is set and the pressurizing force of the second roller 104 or the third roller 105 with respect to the first roller 103 in the moving unit 100 is regulated such that the curl correction amount is obtained. The curl direction is affected by a difference between moisture evaporation rates of an image carrying surface and the opposite surface of the recording sheet. Thus, based on the difference between the moisture evaporation rate of the image carrying surface that is based on the image area ratio and the moisture evaporation rate of the non image carrying surface that is not based on the image area ratio, the curl direction can be decided.

According to an embodiment of the present invention, selectively linking a first roller, a second and a third rollers, and a first and a second transportation paths to a main transportation path enables to change a touching force of the second and the third rollers with respect to the first roller, thus enabling to subject a recording sheet to decurling for curl correction. Due to this, the curl can be corrected regardless of a curl direction by using a single unit and removing a necessity to arrange a plurality of curl correcting mechanisms according to the curl direction. Thus, an increase in a size of the sheet decurling device can be prevented.

A curl amount and a curl direction of the curl that occurs in the sheet change according to a sheet size, environmental temperature and humidity, an area ratio of the toner image etc.

The curl in different directions can be corrected by including a mechanism that corrects the respective curl according to the curl direction. However, using such a structure increases a space occupied by a curl correcting mechanism inside the image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet decurling device that decurls a recording sheet, comprising:

a moving unit including a first transportation path and a second transportation path that can selectively link to a main transportation path of the recording sheet, a first roller arranged between the first transportation path and the second transportation path, a second roller capable of making contact with the first roller across the first transportation path, a third roller capable of making contact with the first roller across the second transportation path, and a driving source that drives the first roller, and that moves its position such that the first transportation path and the second transportation path are selectively linked to the main transportation path;

a moving position detecting unit that detects a position of the moving unit; and a mechanism that varies, upon the moving unit moving to a position at which either one of the first transportation path and the second transportation path is linked to the main transportation path, a pressing force of the second roller or the third roller with respect to the first roller, wherein the mechanism includes an elongated hole formed along a longitudinal direction on a side plate that is arranged separately from the moving unit in a moving direction of the moving unit, into which a rotating shaft of the first roller is inserted, a freely-moving supporting unit that is arranged on a moving unit side, into which the rotating shaft of the first roller is inserted along the longitudinal direction in the moving direction of the moving unit, and supporting units in which rotating shafts of the second roller and the third roller are inserted, respectively, and the freely-moving supporting unit moves without interfering with the first roller, upon a movement of the moving unit continuing when the rotating shaft of the first roller is pressed, according to a moving direction of the moving unit, against one end of the elongated hole, and causes the second roller and the third roller to move independently from the first roller, thus increasing the pressing force of the second roller or the third roller with respect to the first roller.

2. The sheet decurling device according to claim 1, wherein the first transportation path and the second transportation path are arranged one above the other, the driving source moves its position up and down such that the first transportation path and the second transportation path are selectively linked to the main transportation path, the mechanism increases, as the moving unit moves downwardly to the position at which the first transportation path is linked to the main transportation path, the pressing force of the second roller with respect to the first roller, and increases, as the moving unit moves upwardly to the position at which the second transportation path is linked to the main transportation path, the pressing force of the third roller with respect to the first roller, and a rotation direction of the first roller is switchable according to a selection of a linking condition of the first transportation path and the second transportation path to the main transportation path.

3. The sheet decurling device according to claim 1, wherein the second roller and the third roller are arranged at opposite positions across the first roller, and a line connecting contact positions of the second roller and the third roller with respect to the first roller is perpendicular to a conveying direction of the recording sheet that enters the first transportation path or the second transportation path.

4. The sheet decurling device according to claim 1, wherein the first transportation path and the second transportation path are configured such that an entry position and an exit position of the recording sheet links respectively to the main transportation path and a discharging path of the recording sheet that has passed the first transportation path or the second transportation path.

5. The sheet decurling device according to claim 1, wherein the first roller is formed with an elastic roller and the second roller and the third roller are formed with metal rollers, or vice versa.

6. An image forming apparatus comprising a sheet decurling device that decurls a recording sheet, the sheet decurling device including:

a moving unit including a first transportation path and a second transportation path that can selectively link to a main transportation path of the recording sheet, a first roller arranged between the first transportation path and the second transportation path, a second roller capable of making contact with the first roller across the first transportation path, a third roller capable of making contact with the first roller across the second transportation path, and a driving source that drives the first roller, and that moves its position such that the first transportation path and the second transportation path are selectively linked to the main transportation path;

a moving position detecting unit that detects a position of the moving unit; and a mechanism that varies, upon the moving unit moving to a position at which either one of the first transportation path and the second transportation path is linked to the main transportation path, a pressing force of the second roller or the third roller with respect to the first roller, wherein the mechanism includes an elongated hole formed along a longitudinal direction on a side plate that is arranged separately from the moving unit in a moving direction of the moving unit, into which a rotating shaft of the first roller is inserted, a freely-moving supporting unit that is arranged on a moving unit side, into which the rotating shaft of the first roller is inserted along the longitudinal direction in the moving direction of the moving unit, and supporting units in which rotating shafts of the second roller and the third roller are inserted, respectively, and the freely-moving supporting unit moves without interfering with the first roller, upon a movement of the moving unit continuing when the rotating shaft of the first roller is pressed, according to a moving direction of the moving unit, against one end of the elongated hole, and causes the second roller and the third roller to move independently from the first roller, thus increasing the pressing force of the second roller or the third roller with respect to the first roller.

7. The image forming apparatus according to claim 6, wherein the first transportation path and the second transportation path are arranged one above the other, the driving source moves its position up and down such that the first transportation path and the second transportation path are selectively linked to the main transportation path, the mechanism increases, as the moving unit moves downwardly to the position at which the first transportation path is linked to the main transportation path, the pressing force of the second roller with respect to the first roller, and increases, as the moving unit moves upwardly to the position at which the second transportation path is linked to the main transportation path, the pressing force of the third roller with respect to the first roller, and a rotation direction of the first roller is switchable according to a selection of a linking condition of the first transportation path and the second transportation path to the main transportation path.

8. The image forming apparatus according to claim 6, wherein the second roller and the third roller are arranged at opposite positions across the first roller, and a line connecting contact positions of the second roller and the third roller with respect to the first roller is perpendicular to a conveying direction of the recording sheet that enters the first transportation path or the second transportation path.

9. The image forming apparatus according to claim 6, wherein the first transportation path and the second transportation path are configured such that an entry position and an exit position of the recording sheet links respectively to the main transportation path and a discharging path of the recording sheet that has passed the first transportation path or the second transportation path.

10. The image forming apparatus according to claim 6, wherein the first roller is formed with an elastic roller and the second roller and the third roller are formed with metal rollers, or vice versa.

* * * * *